United States Patent [19]

Grgurich

[11] 4,260,112

[45] Apr. 7, 1981

[54] SPRINGLESS FUEL INJECTION NOZZLE

[75] Inventor: William A. Grgurich, Peoria, Ill.

[73] Assignee: Caterpillar Tractor Co., Peoria, Ill.

[21] Appl. No.: 134,619

[22] PCT Filed: Feb. 4, 1980

[86] PCT No.: PCT/US80/00122

§ 371 Date: Feb. 4, 1980

§ 102(e) Date: Feb. 4, 1980

[51] Int. Cl.[3] ..... B05B 1/30

[52] U.S. Cl. ..... 239/533.8; 239/584

[58] Field of Search ..... 239/88, 90–92, 239/95, 96, 453, 456, 533.3–533.5, 533.7–533.9, 533.11, 584

[56] References Cited

U.S. PATENT DOCUMENTS

| | | | |
|---|---|---|---|
| 1,840,256 | 1/1932 | Rohwer | 239/584 |
| 3,368,761 | 2/1968 | Pelizzoni | 239/584 X |
| 3,511,442 | 5/1970 | DeLuca et al. | 239/584 X |
| 3,640,466 | 2/1972 | Steiger | 239/533.8 X |
| 3,791,591 | 2/1974 | Hedges | 239/533.3 X |

*Primary Examiner*—Johnny D. Cherry

[57] ABSTRACT

High pressure undamped springs used in conventional fuel injection nozzle valves cause damage to the valve tip and seat. Also, such undamped springs resonate to admit unwanted fuel in engine cylinders which causes fuel waste and high emissions. Spring breakage and cost are also problems in such nozzle valves. A springless nozzle valve (36) operates on metered use of differential pressure of fuel supplied to the nozzle housing (28) and avoids problems associated with the conventional nozzle valves.

7 Claims, 3 Drawing Figures

SPRINGLESS FUEL INJECTION NOZZLE

DESCRIPTION

TECHNICAL FIELD

This invention relates generally to fluid sprinkling, spraying and diffusing and more particularly to fluid pressure responsive discharge modifiers such as fuel injectors.

BACKGROUND ART

In general, fuel injection nozzle valves operate in response to high pressure fuel creating forces acting on differential areas of the valve causing rapid reciprocation of the valve. The rapid reciprocation causes intermittent seating and unseating of a tip of the valve with a valve seat which permits the fuel to be injected into engine cylinders.

In one type of fuel injector, fuel at one pressure acts on one side of the valve to lift or unseat the valve for starting fuel injection, and fuel at another pressure acts opposite the one pressure to seat the valve for stopping fuel injection.

Another type of fuel injector utilizes fuel pressure acting on one side of the valve to lift or unseat the valve for starting fuel injection, and a high rate spring acts opposite the fuel pressure to seat the valve for stopping fuel injection.

The high rate springs are a costly item and are subject to breakage which of course requires replacement. Also, the forces created by such springs cause tip damage to the needle valves commonly used in such nozzles due to the high impact loads occurring when the valves seat.

Further, high impact loads caused by spring forces often create a resonance in the undamped spring which causes the needle valve to bounce. Such bounce permits undesirable leakage of fuel into an engine cylinder after injection. As a result, the leaked fuel is admitted to the cylinder out of cycle and thus is not fully consumed. This results in increased emissions and poor fuel economy.

The foregoing illustrates limitations of the known prior art. Thus, it is apparent that it would be advantageous to provide an alternative directed to overcoming one or more of the limitations as set forth above.

DISCLOSURE OF INVENTION

In one aspect of the present invention, this is accomplished by providing a springless fuel injection nozzle including a housing having a fuel cavity including upper and lower cavity portions separated by a valve guide. A conduit supplies high pressure fuel only to the lower cavity portion.

A valve reciprocates to meter fuel between the upper and lower cavity portions. The valve reciprocation results from pressure differentials acting on the valve without the aid of any resilient member acting on the valve.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BEST MODE FOR CARRYING OUT THE INVENTION

Figure 1:
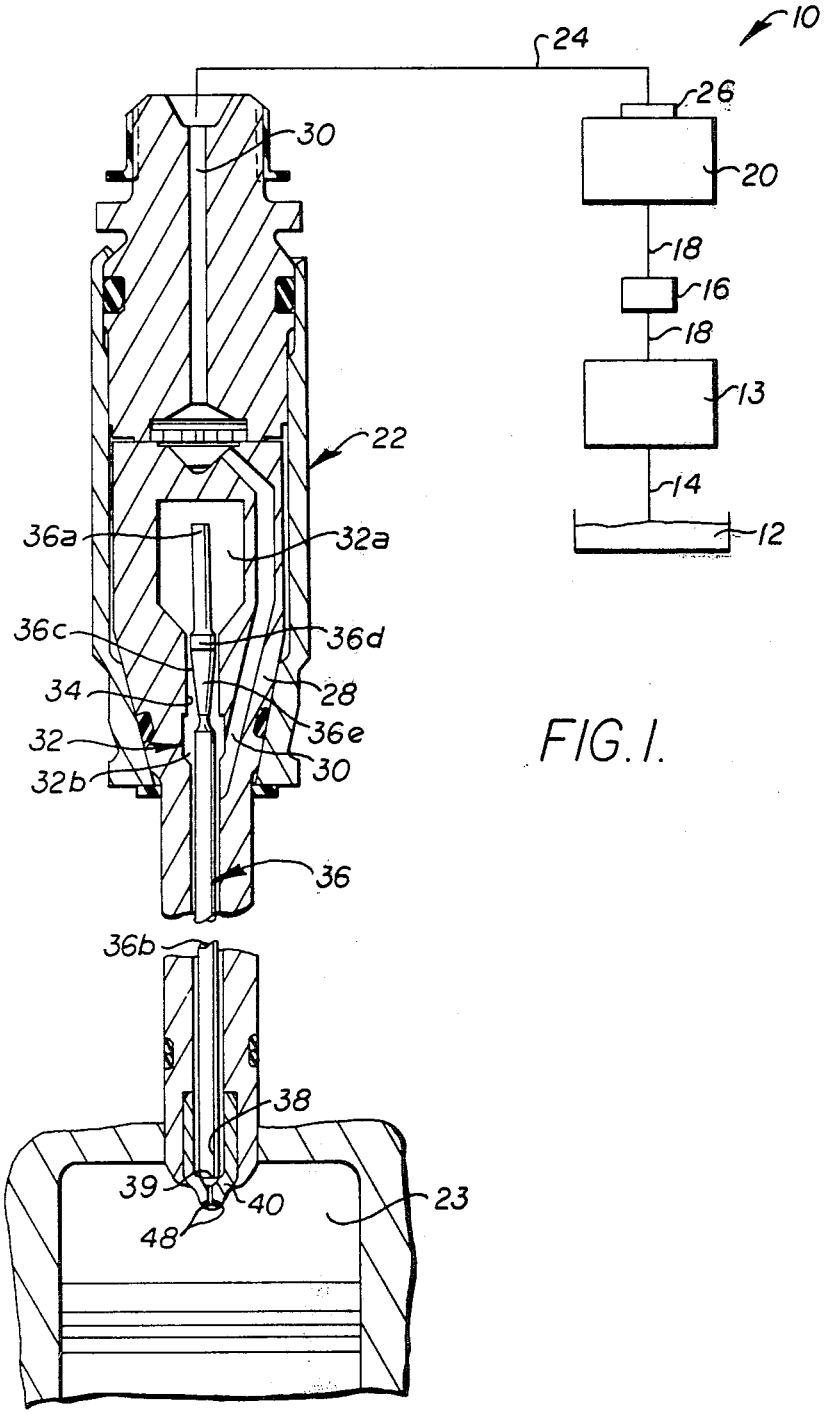
FIG. 1 is a view illustrating a fuel system including an embodiment of the present invention.

In FIG. 1, a fluid fuel system is generally designated 10, and includes a reservoir 12. A well known fuel transfer pump 13 is connected via a conduit 14 for pumping fuel from reservoir 12 at a system pressure of about 30–35 psi. The fuel is then passed through a known filter 16 in conduit 18 to a conventional high pressure fuel injection pump 20 which supplies the fuel at pressures ranging from about 2000 psi to about 15,000 psi and then to a fuel injection nozzle 22 via a conduit 24. It is preferred that a known reverse flow check valve 26 is between high pressure pump 20 and nozzle 22 to check against pressure waves which may oscillate between pump 20 and nozzle 22 as a result of rapidly created high pressure surges of fuel being pumped through nozzle 22 into an associated engine cylinder 23 at a rate of several times per second.

Nozzle 22 comprises a housing 28 having a fuel passage 30 for communicating fuel between system 10 and cavity 32 formed in housing 28.

Housing 28 is preferably formed of high carbon steel and defines an upper cavity portion **32*a* and a lower cavity portion 32*b* and further defines a reduced diameter cylindrical guide 34 separating the upper and lower cavity portions 32*a*, 32*b***, respectively.

In the preferred embodiment, passage 30 is connected so that fuel communication with cavity 32 occurs only at lower cavity portion **32*b*. Once fuel communicates with lower cavity portion 32*b*, fuel fills upper cavity portion 32*a* only through guide 34. Thus, upper cavity portion 32*a* comprises a trapped volume. Lower cavity portion 32*b* includes conventional fuel injection orifices 48**.

It has been found that the preferred trapped volume of upper cavity portion **32*a* is at least from about 2 cc to about 12 cc; the volume of lower cavity portion is at least about 5 cc to about 16 cc and the diameter of guide 34** is about 3.9883 cm.

A valve member 36 is preferably formed of a high carbon steel and is reciprocably disposed in cavity 32. An extended upper valve portion **36*a* extends into upper cavity portion 32*a*. Valve 36 includes a lower valve portion 36*b* extending into lower cavity portion 32*b* and having a tip 38 engaged with a valve seat 40 at a seating contact diameter 39 of at least from about 0.142 cm to about 0.279 cm so as to block fuel from communicating between lower cavity portion 32*b* and orifices 48. Upper and lower valve portions 36*a*, 36*b*, respectively, are separated by an intermediate enlarged diameter valve portion 36*c* which reciprocates within guide 34 and has a variable diameter so as to form a variable clearance with guide 34**.

Figure 2:
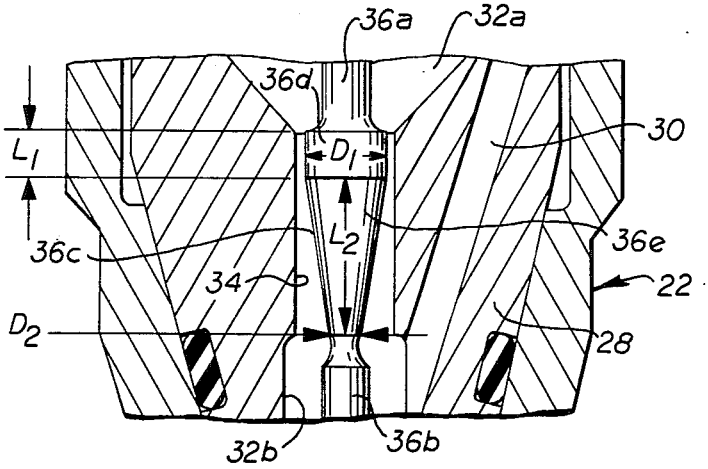
FIG. 2 is a view illustrating an enlarged partial section of the nozzle valve guide and guide clearance of this invention.

More specifically, valve portion **36*c* has a first diameter portion 36*d* adjacent upper cavity 32*a* and has a second diameter portion 36*e* adjacent lower cavity 32*b*. First diameter portion 36*d* has a diameter $D_1$ of at least about 0.3988 cm along a length $L_1$ of at least about 0.0102 cm. Second diameter portion 36***e* is frusto-conical and extends to a length $L_2$ of at least about 0.0305 cm from the constant diameter portion tapering to a reduced diameter $D_2$ of at least about 0.3968 cm (See FIGS. 2 and 3).

Surprisingly and unexpectedly, the unique structure of valve portion 36*c* permits valve 36 to reciprocate in cavity 32 to meter fuel between upper cavity 32*a* and lower cavity 32*b* due only to differential fuel pressure acting on valve 36 so that nozzle 22 functions free of any resilient member acting on valve 36.

The variable diameter of intermediate valve portion 36*c* permits clearance between valve portion 36*c* and guide 34 to vary from at least about 0.0003 cm between constant diameter portion 36*d* and guide 34 to at least about 0.0023 cm between frusto-conical portion 36*e* and guide 34.

Industrial Applicability

With the parts assembled as set forth above peak pressure in system 10 reaches about 15,000 psi to act on constant diameter 36*d* less seating contact diameter 39 for lifting valve 36 and permit fuel to be injected through orifices 48. System 10 pressure drops to about 30–35 psi as the system goes on bypass and valve 36 seats for cutting off injection in the well-known manner. Pressure in upper cavity portion 32*a* acts on constant diameter portion 36*d* to seat the valve 36.

Figure 3:
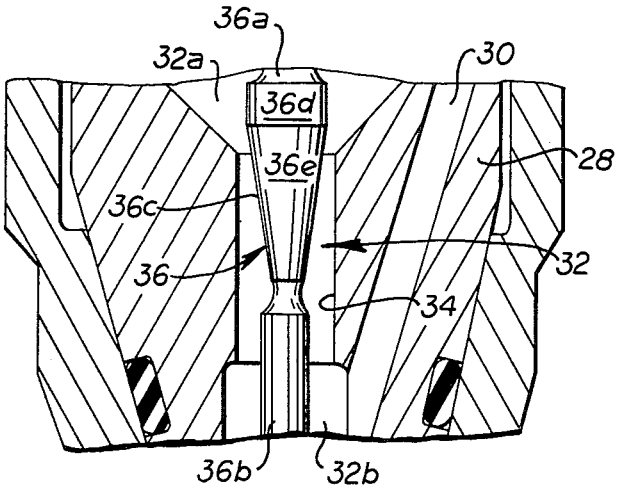
FIG. 3 is another view illustrating an enlarged partial section of the nozzle valve guide and guide clearance.

According to this invention it has been found that peak pressure in upper cavity portion 32*a* maintains substantially steady at about 1,000 psi during both idle and full loads. During idle, when peak system pressure is about 3000 to 5000 psi, valve 36 lifts about 0.0102 cm during injection which maintains constant diameter portion 36*d* within guide 34, see FIG. 2. Thus, the substantially tight guide clearance of at least about 0.0003 cm restricts fuel communication between upper cavity portion 32*a* and lower cavity portion 32*b*. During full loads, when peak system pressure is about 15,000 psi, valve 36 lifts about 0.0305 cm during injection which lifts constant diameter portion 36*d* entirely out of guide 34 and into upper cavity portion 32*a* thus lifting frusto-conical portion 36*e* to a position, as illustrated in FIG. 3, where clearance between guide 34 and frusto-conical portion 36*e* increases substantially to at least about 0.0023 cm. As a result, a sufficient amount of higher pressure fuel in lower cavity portion 32*b* is permitted to bleed into the trapped volume of upper cavity portion 32*a*. However, before the bleed pressure is permitted to appreciably affect peak trapped volume pressure, system 10 goes on bypass and injection is stopped. When injection is stopped, the substantially steady peak trapped volume pressure of about 1,000 psi is sufficient to urge tip 38 against seat 40 free of any resilient member such as springs used in some conventional fuel injection nozzle.

The springless nozzle 22 is advantageous for many reasons. The 1,000 psi peak trapped volume pressure is a relatively light load on valve 36 and the absence of a spring limits the possibility of the valve bouncing at tip 38 and seat 40. Such bouncing is common where undamped springs resonate when used to seat fuel injection nozzle valves. Such bouncing is a major cause of tip wear, tip breakage and increased emissions. Elimination of a spring also precludes spring breakage and reduces cost. Another observable advantage has been that timing of injection is retarded with load at any speed due to the fact that trapped volume residual pressure increases with load.

The foregoing has described a fuel injection nozzle including a housing and a valve reciprocating in the housing to meter fuel between upper and lower cavity portions. The valve reciprocation results from pressure differentials acting on the valve without the aid of any resilient member acting on the valve.

It is anticipated that aspects of the present invention, other than those specifically defined in the appended claims, can be obtained from the foregoing description and the drawings so that the above-stated parameters may be varied to meet criteria for various fuel systems.

I claim:

1. In a fuel injection nozzle (22) of the type including a housing (28) having a fluid cavity (32) having an upper cavity portion (32*a*) fluidly connected to a lower cavity portion (32*b*), said housing (28) having a valve guide (34) formed between said upper and lower cavity portions (32*a*,32*b*), said housing (28) having means (30) for supplying pressurized fluid to said cavity portions (32*a*,32*b*) of said cavity (32), said means (30) connected to said cavity (32) only at said lower cavity portion (32*b*), said housing (28) having fluid outlet orifices (48) only at said lower cavity portion (32*b*), said housing (28) having a reciprocable valve (36), said valve having an upper valve portion (36*a*) extending into said upper cavity portion (32*a*), a lower valve portion (36*b*) extending into said lower cavity portion (32*b*) and an intermediate valve portion (36*c*) within said guide (34), an improvement comprising:

said intermediate valve portion (36*c*) forming a variable clearance with said guide (34); and said nozzle (22) being free of any resilient member acting on said valve (36).

2. The nozzle of claim 1 wherein said intermediate valve portion (36*c*) includes a variable diameter.

3. The nozzle of claim 1 wherein said intermediate valve portion (36*c*) includes a first diameter portion (36*d*) adjacent said upper cavity portion (32*a*) and includes a second diameter portion (36*e*) adjacent said lower cavity portion (32*b*), said second diameter portion (36*e*) being less than said first diameter portion (36*d*).

4. The nozzle of claim 1 wherein said intermediate valve portion (36*c*) includes a constant diameter portion (36*d*) adjacent said upper cavity portion (32*a*) and includes a frusto-conical portion (36*e*) extending from said constant diameter portion and tapering to a reduced diameter less than said constant diameter portion (36*d*).

5. A fuel injection nozzle (22) comprising:

a housing (28), said housing having a fluid cavity (32) including an upper cavity portion (32*a*) fluidly connected to a lower cavity portion (32*b*), said housing having a valve guide (34) formed between said upper and lower cavity portions (32*a*,32*b*), said housing having means (30) for supplying pressurized fluid to said portions (32*a*,32*b*) of said cavity (32), said means (30) connected to said cavity (32) only at said lower cavity portion (32*b*), and said housing having fluid outlet orifices (48) only at said lower cavity portion (32*b*);

means for metering fluid between said upper cavity portion (32*a*) and said lower cavity portion (32*b*), said means being a reciprocable valve (36) having an upper valve portion (36*a*) extending into said upper cavity portion (32*a*), a lower valve portion (36*b*) extending into said lower cavity portion (32*b*) and an intermediate valve portion (36*c*) within said guide (34), said intermediate valve portion (36*c*) forming a variable clearance with said guide (34); and said nozzle (22) being free of any resilient member acting on said valve (36).

6. A fuel system (10) comprising:

a fuel reservoir (12);

a fuel transfer pump (13) connected for pumping fuel from said reservoir (12);

a high pressure fuel pump (20) connected for pumping and pressurizing said fuel from said fuel transfer pump (13);

a fuel injection nozzle (22) comprising a housing (28), said housing having a fluid cavity (32) including an upper cavity portion (32*a*) fluidly connected to a lower cavity portion (32*b*), said housing having a valve guide (34) formed between said upper and lower cavity portions (32*a*,32*b*), said housing having means (30) for supplying pressurized fluid to said portions (32*a*,32*b*) of said cavity (32), said means (30) connected to said cavity (32) only at said lower cavity portion (32*b*), and said housing having fluid outlet orifices (48) only at said lower cavity portion (32*b*); and means for metering fluid between said upper cavity portion (32*a*) and said lower cavity portion (32*b*), said means being a valve (36) having an upper valve portion (36*a*) extending into said upper cavity portion (32*a*), a lower valve portion (36*b*) extending into said lower cavity portion (32*b*) and an intermediate valve portion (36*c*) within said guide (34), said intermediate valve portion (36*c*) forming a variable clearance with said guide (34); and said nozzle (22) being free of any resilient member acting on said valve (36).

7. A fuel injection nozzle (22) comprising:

a housing (28), said housing having a fluid cavity (32) including an upper cavity portion (32*a*) fluidly connected to a lower cavity portion (32*b*), said housing having a valve guide (34) formed between said upper and lower cavity portions (32*a*,32*b*), said housing having means (30) for supplying pressurized fluid to said portions (32*a*,32*b*) of said cavity (32), said means (30) connected to said cavity (32) only at said lower cavity portion (32*b*), and said housing having fluid outlet orifices (48) only at said lower cavity portion (32*b*); and means for moving in said cavity (32) for intermittently seating with said housing (28) for starting and stopping fuel injection through said orifices (48), said means being a reciprocable valve (36) having an upper valve portion (36*a*) extending into said upper cavity portion (32*a*), a lower valve portion (36*b*) extending into said lower cavity portion (32*b*) and an intermediate valve portion (36*c*) within said guide (34) for metering said fluid and varying pressure between said upper cavity portion (32*a*) and said lower cavity portion (32*b*) in response to said intermediate valve portion (36*c*) forming a variable clearance with said guide (34), said nozzle (22) being free of any resilient member acting on said valve (36).

* * * * *